US007353832B2

(12) United States Patent
Stockert et al.

(10) Patent No.: US 7,353,832 B2
(45) Date of Patent: Apr. 8, 2008

(54) HOUSINGLESS WASHER

(75) Inventors: David L. Stockert, New Boston, MI (US); Timothy B. Evans, Livonia, MI (US); Robert J. Sobeck, Livonia, MI (US)

(73) Assignee: Cinetic Automation Corporation, Farmington Hills, MI (US)

( * ) Notice: Subject to any disclaimer, the term of this patent is extended or adjusted under 35 U.S.C. 154(b) by 635 days.

(21) Appl. No.: 10/646,534

(22) Filed: Aug. 21, 2003

(65) Prior Publication Data

US 2005/0039784 A1 Feb. 24, 2005

(51) Int. Cl.
*B08B 3/02* (2006.01)

(52) U.S. Cl. ..... 134/147; 134/153; 134/200

(58) Field of Classification Search ..... 134/200, 134/147, 153, 102.1
See application file for complete search history.

(56) References Cited

U.S. PATENT DOCUMENTS

| | | | | |
|---|---|---|---|---|
| 2,216,698 | A | 10/1940 | Arey et al. | |
| 2,258,562 | A | 10/1941 | Arey et al. | |
| 2,393,215 | A | 1/1946 | Arey et al. | |
| 2,405,838 | A | 8/1946 | Lawson et al. | |
| 2,681,069 | A * | 6/1954 | Marshall et al. | 134/175 |
| 2,873,816 | A | 2/1959 | Umbricht | |
| 2,926,674 | A | 3/1960 | Umbricht et al. | |
| 3,009,468 | A * | 11/1961 | Eberle | 134/93 |
| 3,059,861 | A | 10/1962 | Umbricht et al. | |
| 3,276,458 | A | 10/1966 | Iversen et al. | |
| 3,439,810 | A | 4/1969 | Newman et al. | |
| 3,605,775 | A | 9/1971 | Zaander et al. | |
| 3,614,231 | A | 10/1971 | Shaw | |
| 3,624,750 | A * | 11/1971 | Peterson | 134/96.1 |
| 3,664,355 | A * | 5/1972 | Adams | 134/143 |
| 3,870,417 | A | 3/1975 | Bashark | |
| 3,888,269 | A | 6/1975 | Bashark | |
| 3,889,696 | A * | 6/1975 | Ousterling et al. | 134/57 R |
| 4,015,615 | A | 4/1977 | Weber et al. | |
| 4,067,293 | A * | 1/1978 | Probst | 118/73 |
| 4,170,240 | A * | 10/1979 | Gentry | 134/57 R |
| 4,177,855 | A * | 12/1979 | Duchateau et al. | 164/488 |
| 4,222,250 | A | 9/1980 | Torita | |

(Continued)

FOREIGN PATENT DOCUMENTS

CA 656624 1/1963

(Continued)

OTHER PUBLICATIONS

European Patent Office 0 227 275 Jul. 1987.*

(Continued)

*Primary Examiner*—Frankie L. Stinson
(74) *Attorney, Agent, or Firm*—Harness, Dickey & Pierce, P.L.C.

(57) ABSTRACT

An industrial parts washer includes a stand adapted to support a part, a chamber selectively movable from a first position clear of the part to a second position engaging the stand where the chamber forms a closed volume encapsulating the part. A nozzle is positioned within the chamber to supply pressurized fluid for cleaning the part. The industrial parts washer may include a washing station positioned adjacent a drying station where each of the washing and drying stations include chambers selectively movable to enclose the part.

16 Claims, 6 Drawing Sheets

U.S. PATENT DOCUMENTS 4,317,426 A 3/1982 Wheten
4,323,398 A * 4/1982 Simon ..... 134/18
4,325,161 A 4/1982 Wood et al.
4,350,174 A 9/1982 Bolten et al.
4,381,794 A 5/1983 Stimac et al.
4,409,999 A 10/1983 Pedziwiatr
4,413,977 A 11/1983 Takano et al.
4,469,526 A * 9/1984 Budinsky et al. ..... 134/25.4
4,493,333 A 1/1985 Layton
4,571,270 A * 2/1986 Sasaki ..... 134/5
4,582,077 A 4/1986 Gabriel et al.
4,600,444 A * 7/1986 Miner ..... 134/8
4,722,295 A * 2/1988 Young ..... 118/416
4,731,154 A 3/1988 Hausman Hazlitt et al.
4,796,042 A 1/1989 Mappin et al.
4,821,753 A * 4/1989 Nakamura et al. ..... 134/59
4,892,111 A 1/1990 Parslow, Jr. et al.
4,893,320 A 1/1990 Yanagi et al.
4,895,205 A * 1/1990 Thompson et al. ..... 166/90.1
4,936,328 A 6/1990 Yatabe
4,941,971 A * 7/1990 Albright ..... 210/107
4,995,409 A 2/1991 Watts
4,996,160 A 2/1991 Hausman Hazlitt et al.
5,000,206 A * 3/1991 Kramer et al. ..... 134/34
5,014,726 A 5/1991 Lindvall
5,143,102 A * 9/1992 Blaul ..... 134/58 R
5,154,199 A 10/1992 Thompson et al.
5,172,572 A 12/1992 Ono
5,174,315 A 12/1992 Hellstern et al.
5,188,135 A * 2/1993 Neumann et al. ..... 134/64 R
5,201,958 A 4/1993 Breunsbach et al.
5,265,446 A 11/1993 Kuroda et al.
5,272,892 A 12/1993 Janutka et al.
5,284,523 A 2/1994 Badami et al.
5,291,626 A 3/1994 Molnar et al.
5,330,580 A 7/1994 Whipple, III et al.
5,339,844 A 8/1994 Stanford, Jr. et al.
5,346,629 A 9/1994 Wuller
5,357,648 A 10/1994 Noestheden
5,368,053 A 11/1994 Wilson
5,396,178 A 3/1995 Rybarski
5,411,042 A 5/1995 Suzuki et al.
5,421,883 A 6/1995 Bowden
5,444,531 A 8/1995 Foreman et al.
5,464,483 A 11/1995 Avelis et al.
5,470,394 A * 11/1995 Michel et al. ..... 134/25.4
5,545,259 A 8/1996 Suzuki et al.
5,555,583 A 9/1996 Berkcan
5,560,060 A 10/1996 Dausch et al.
5,586,567 A 12/1996 Smith et al.
5,630,435 A 5/1997 Brouchoud et al.
5,647,386 A 7/1997 Kaiser
5,661,872 A 9/1997 Meyer et al.
5,706,840 A 1/1998 Schneider et al.
5,730,163 A 3/1998 Meyer et al.
5,746,233 A 5/1998 Kuroda et al.
5,800,628 A 9/1998 Erickson et al.
5,815,762 A 9/1998 Sakai et al.
5,846,337 A 12/1998 Uchinami et al.
5,923,432 A 7/1999 Kral
5,931,173 A 8/1999 Schiele
5,934,869 A * 8/1999 Janisse ..... 415/121.3
5,954,070 A 9/1999 Abad et al.
5,954,071 A 9/1999 Magliocca
5,960,804 A 10/1999 Cooper et al.
6,007,640 A 12/1999 Neff et al.
6,073,640 A * 6/2000 McTaggart ..... 134/103.1
6,115,541 A 9/2000 Rhodes
6,119,365 A 9/2000 Wuller et al.
6,126,099 A 10/2000 Fachinger et al.
6,129,099 A 10/2000 Foster et al.
6,165,277 A 12/2000 Florez
6,234,080 B1 * 5/2001 Tani ..... 101/424
6,319,329 B1 11/2001 Kamikawa et al.
6,321,760 B1 * 11/2001 Meissner ..... 134/80
6,334,266 B1 * 1/2002 Moritz et al. ..... 34/337
6,342,104 B1 1/2002 Kamikawa et al.
6,467,189 B2 10/2002 Kuroda
6,575,178 B1 6/2003 Kamikawa
6,913,650 B2 7/2005 Gilmore et al.
2001/0015096 A1 8/2001 Hoffman

FOREIGN PATENT DOCUMENTS

CA 667441 7/1963
CA 669262 8/1963
CA 699331 12/1964
CA 699537 12/1964
DE 41 25 891 * 2/1993
GB 817851 8/1959
GB 817860 8/1959
JP 55-103608 8/1980
JP 56-97512 8/1981
JP 60-16275 1/1985
JP 60-21798 2/1985
JP 60-163689 8/1985
JP 61-25599 2/1986
JP 62-259442 11/1987
JP 2-107296 4/1990
RU 2018384 * 8/1994

OTHER PUBLICATIONS

European Patent Office 0 341 184 Nov. 1989.*
European Patent Office 0 022 307 Jan. 1981.*
European Patent Office 0 065 861 Dec. 1982.*
European Patent Office 0 110 525 Jun. 1984.*
Owner's Manual, "Model 215W Liquidborne Laser Particle Counter," (believed to have been published and/or offered for sale in 1995).
Drawing No. 4792692-M-170A05A showing the Daimler-Chrysler Kenosha Plant, Station #5 Seal & Flush, Transfer Machine Serial No. 7100-001, 1 page, (believed to have been offered for sale prior to 2002).

* cited by examiner

HOUSINGLESS WASHER

BACKGROUND AND SUMMARY OF THE INVENTION

The present invention generally relates to a washer for industrial parts and, more particularly, to a washer which eliminates the need for a large enclosure.

Manufactured industrial parts, such as machined metallic components, become coated with cutting fluids, lubricating oils, machine coolants, metal fragments and other contaminants during the manufacturing process. For example, metal cutting operations often include the steps of applying a lubricant to the cutting tool and part being machined. Lubricant residue and metal chips often adhere to the surface of the part. Industrial parts washers are used to remove undesired contaminants and clean the part prior to use.

Industrial parts washers typically include one or more processing zones for washing, rinsing, drying and other steps for cleaning the parts. A conveyor typically transports the parts through the processing zones from one end of the washer to the other. Because industrial parts washers typically spray the parts with heated liquid cleaners, most washers include an enclosure to capture the spray and contaminants being washed.

The enclosure of a typical industrial parts washer ordinarily incorporates a large metal housing which extends along nearly the entire length of the machine. Although such enclosures have proven to be quite durable and relatively easy to fabricate, they are large, unwieldy and relatively costly. Access to the machines within the enclosure is oftentimes limited thereby making maintenance and retooling of the machines difficult. Furthermore, because the majority of the machines used to wash, rinse and dry the part are located within the enclosure, the machines are detrimentally exposed to the harsh solvent spray throughout their life.

Several manufacturers of industrial parts washers have attempted to address the problem of access by adding doors or removable side panels to the side of the enclosure. However, the restricted openings hinder access to the interior volume of the enclosure. Other manufacturers have attempted to provide an enclosure which is removable in its entirety. However, due to the size and weight of the requisite enclosure, mechanical lifts or cranes are usually needed to raise the enclosure. Accordingly, there is a need for a housingless industrial parts washer having reduced size and complexity.

SUMMARY OF THE INVENTION

The industrial parts washer of the present invention includes a stand adapted to support the part to be washed and a moveable chamber. The chamber is moveable from a returned position clear of the part to an advanced position engaging the stand where the chamber and the stand form a sealed unit encapsulating the part. A nozzle assembly is coupled to a pressurized fluid supply and positioned within the chamber.

In one embodiment, a moveable wash ring having a plurality of manifold mounted nozzles mounted thereto is advanced across the part during the washing cycle. The nozzles are positioned substantially about the periphery of the part to provide a plurality of fluid paths for washing strategic areas of the part.

In another embodiment, the industrial parts washer of the present invention includes a washing station and a drying station. The drying station is positioned downstream of the washing station and includes a separate moveable chamber and part support stand. The drying station includes a plurality of nozzles plumbed to spray dry air on the part after it has been enclosed within the moveable chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
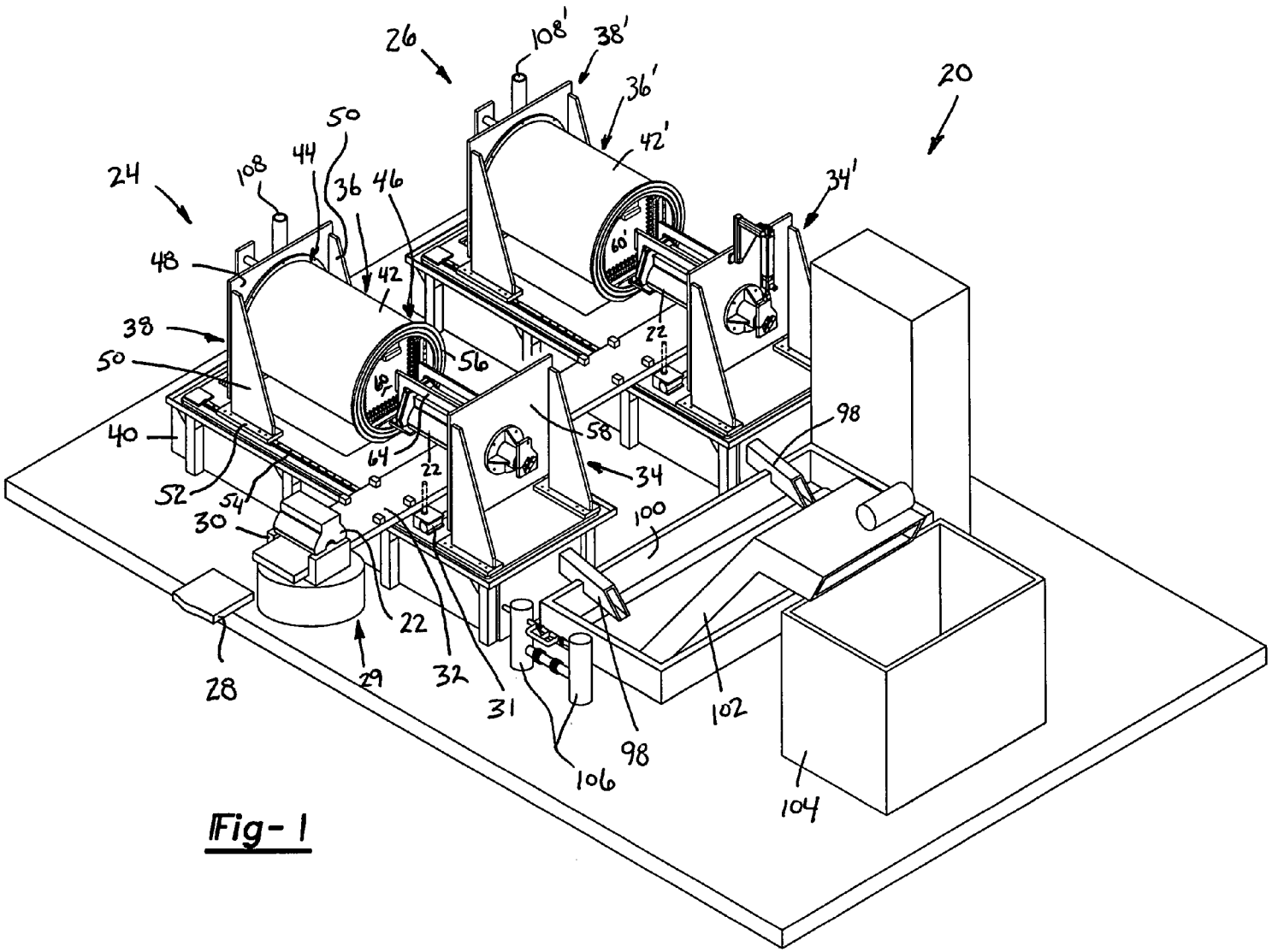
FIG. 1 is a perspective view of an industrial parts washer constructed in accordance with the teachings of the present invention.

Referring to FIG. 1, a preferred embodiment of a parts washer 20 for use in an industrial manufacturing plant to clean industrial parts or workpieces such as automotive vehicle powertrain components, including a part 22 or the like is shown. Parts washer 20 operates as a cleaning station typically positioned after a machining station (not shown) where the part has been machined by a mill, a lathe, a grinding machine or a similar industrial tool. During the machining process, lubrication, grease, dirt and burrs often adhere to the walls of internal passageways and the external surface of the machined part.

Parts washer 20 includes a washing station 24 and a drying station 26 positioned adjacent to one another. A conveyor 28 transports part 22 from a machining center (not shown) to a transfer system 29. Transfer system 29 includes a turntable 30 where part 22 is rotated into proper alignment for loading into washing station 24. Transfer system 29 also includes a lift 32 which is operable to transport a recently machined part from turntable 30 to washing station 24 and simultaneously transfer a washed part from washing station 24 to drying station 26. To accomplish this task, a driver 31 is operable to vertically move and horizontally translate lift 32 to properly position the parts 22.

Figure 2:
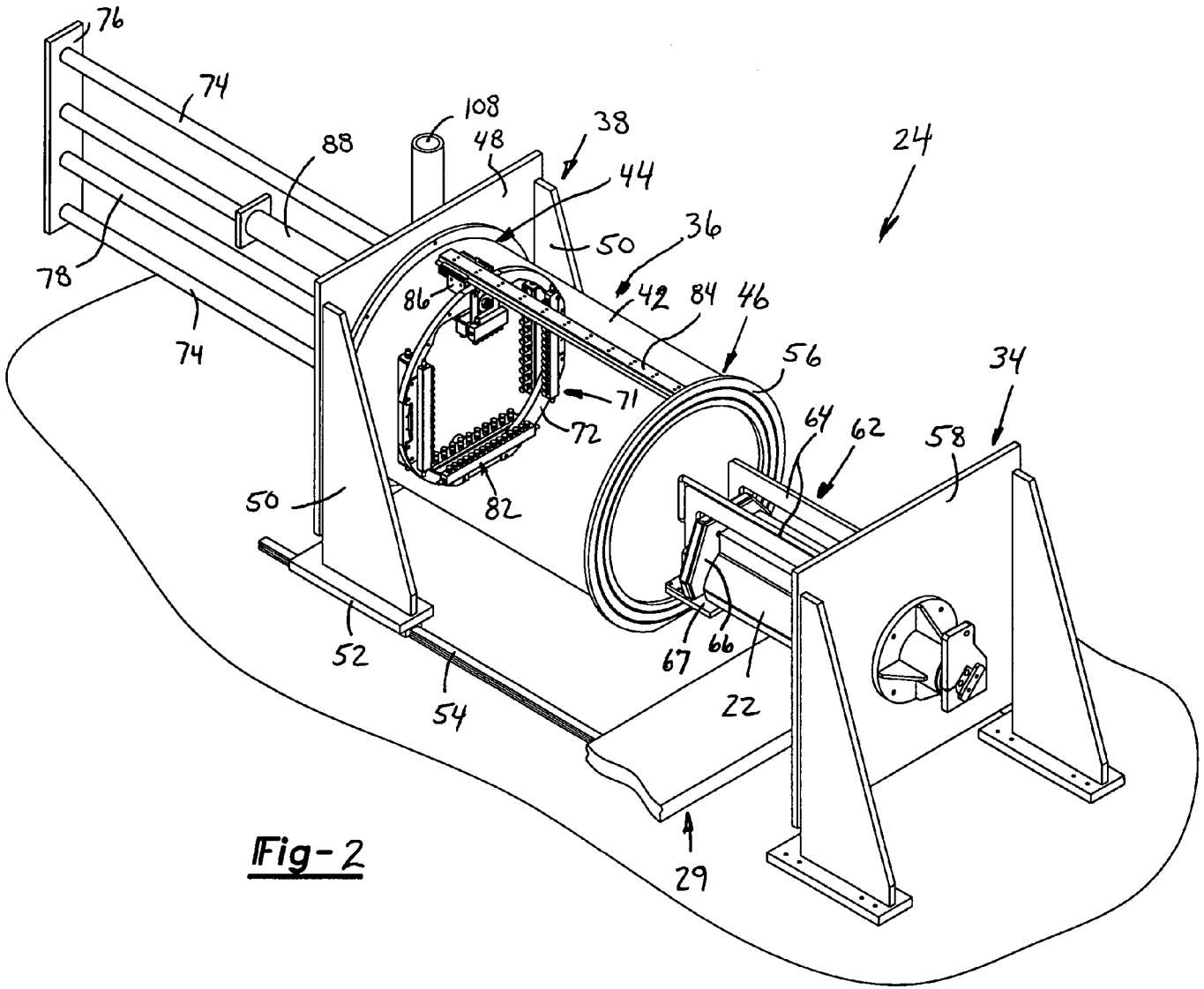
FIG. 2 is a partial perspective view depicting a washing station of the industrial parts washer of the present invention having a chamber positioned in an open position.
Figure 3:
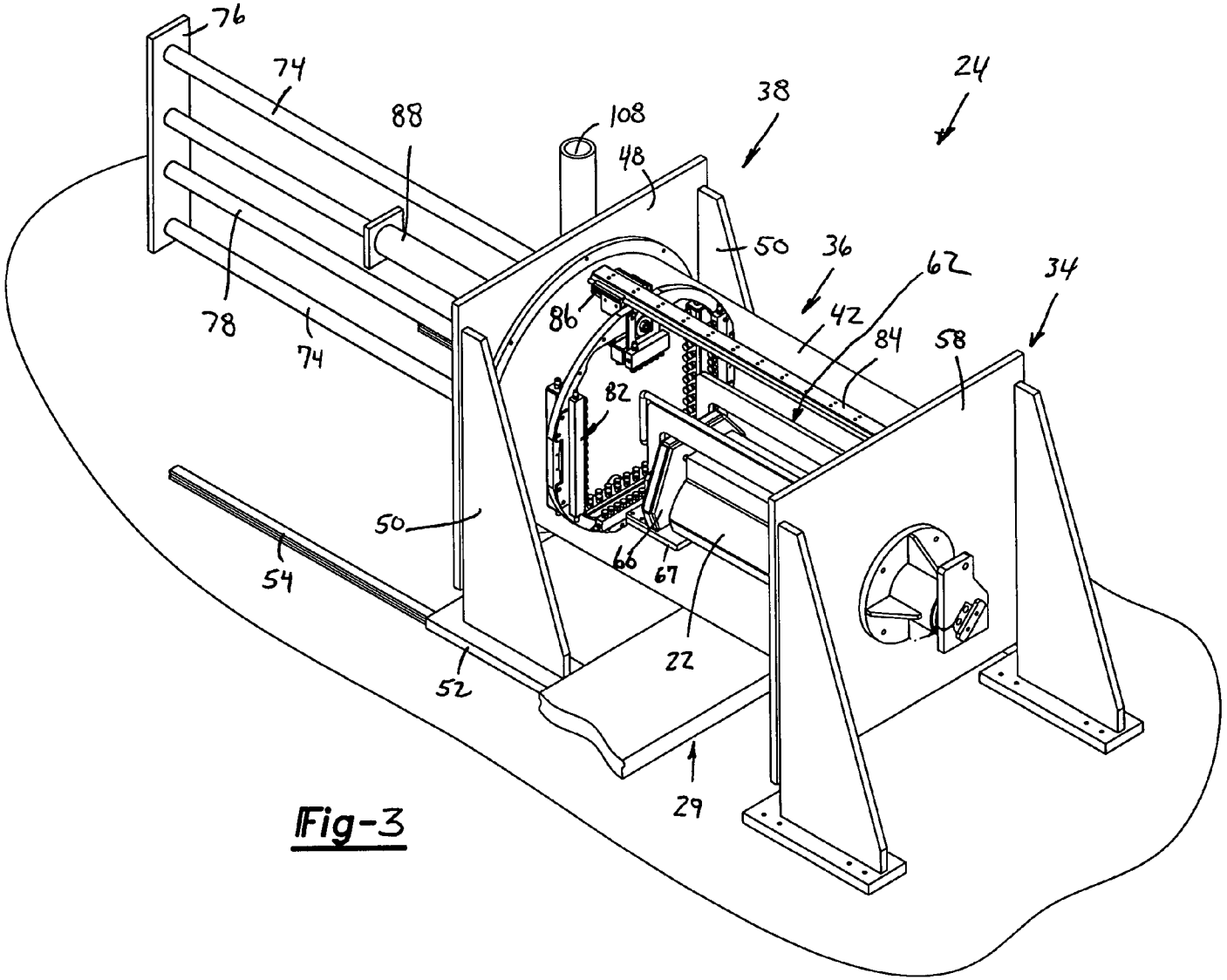
FIG. 3 is a partial perspective view depicting a washing station of the industrial parts washer of the present invention where the chamber is in a closed position.

As best shown in FIGS. 2 and 3, washing station 24 includes a stand 34 for supporting part 22, a chamber 36, a slide 38 and a table 40. Chamber 36 is a generally hollow cylindrical member having a wall 42, first end 44 and a second end 46. First end 44 is coupled to an end plate 48 of slide 38. Chamber 36 is preferably constructed from a lightweight, translucent material to allow an operator to view the washing process. Slide 38 includes a pair of side plates 50 coupled to end plate 48. Each side plate 50 is mounted on a carriage 52. Each carriage 52 is slidable relative to table 40 along a track 54. Chamber 36 is mounted in a cantilevered fashion having its longitudinal axis positioned substantially parallel to and spaced apart from the floor.

Based on this mounting arrangement, chamber 36 may be selectively positioned in an open position shown in FIG. 1 or a closed position as shown in FIG. 3. In the open position, second end 46 of chamber 36 is open to atmosphere and access to part 22 is allowed. When chamber 36 is in the closed position, a seal 56 located on second end 46 of chamber 36 engages a mounting plate 58 of stand 34. An enclosed volume 60 is formed inside chamber 36 once seal 56 engages mounting plate 58.

Figure 4:
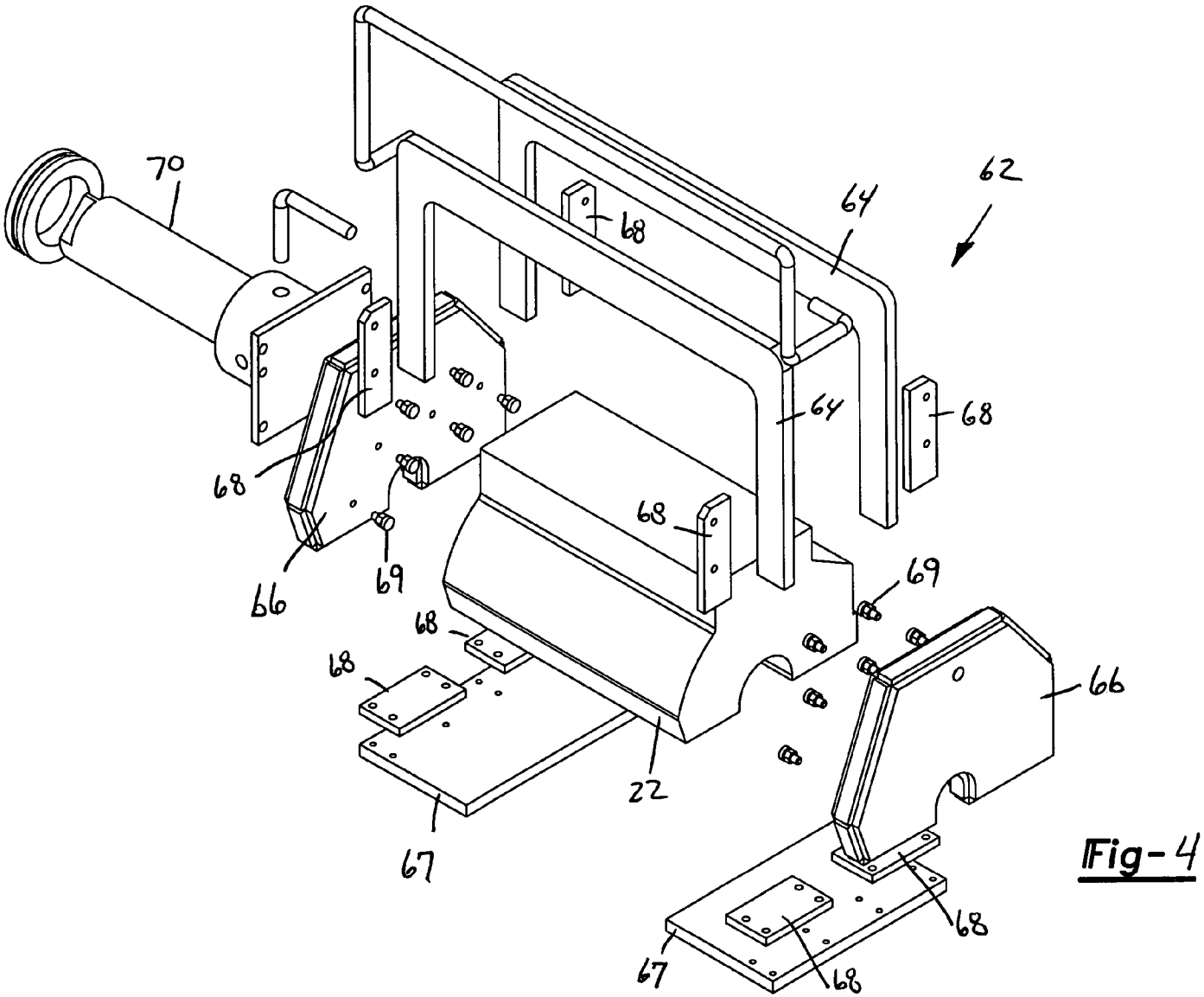
FIG. 4 is an exploded perspective view of a part support structure of the industrial parts washer of the present invention.

FIG. 4 depicts a part support structure 62 including a pair of generally "C" shaped frames 64, a pair of wash plates 66, two inwardly extending ledges 67, and a number of stop plates 68. A plurality of nozzles 69 are mounted to wash plates 66 to provide wash spray to the end portions of part 22. Ledges 67 provide support for part 22 during washing. A spindle 70 rotatably couples support structure 62 to mounting plate 58 of stand 34. Stop plates 68 retain part 22 in a desired location should there be a need to rotate the part such as during the drying phase as will be described in detail hereinafter.

Figure 5:
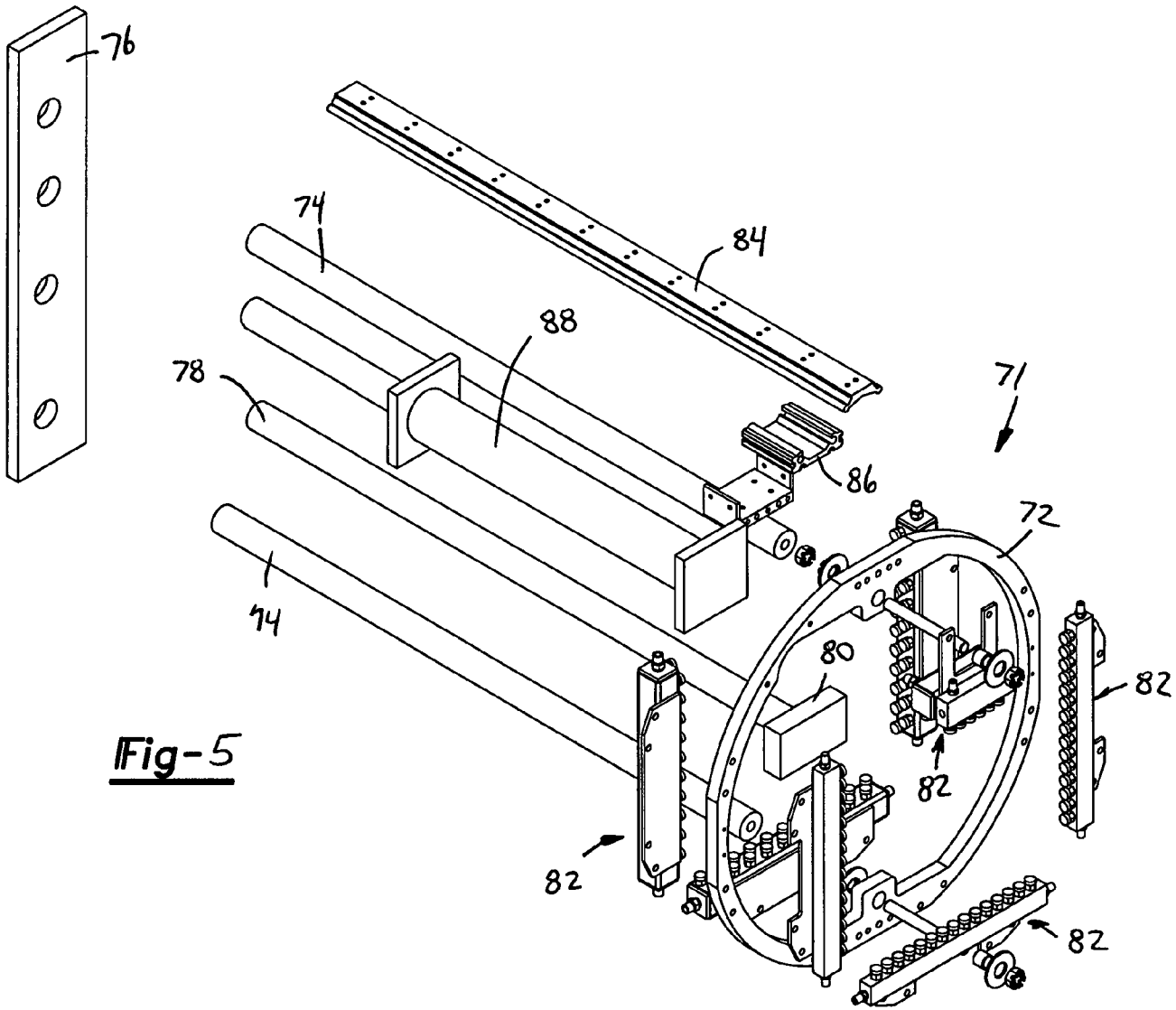
FIG. 5 is an exploded perspective view of a wash ring of the industrial parts washer of the present invention.

As best shown in FIGS. 3 and 5, a wash ring 71 is movably mounted within chamber 36. Wash ring 71 includes a halo 72 mounted to a pair of guide rods 74. Guide rods 74 extend through chamber 36 and end plate 48. Each guide rod 74 is coupled to a support 76 which maintains a proper spacing between each of the guide rods. A water supply line 78 is also coupled to support 76 and halo 72. Supply line 78 is in fluid communication with a valve assembly 80 which is controllable to selectively supply pressurized fluid to four sets of nozzles 82 mounted to halo 72. Each set of nozzles is preferably orientated orthogonally relative to an adjacent set of nozzles to provide cleaning fluid to the entire perimeter of part 22. To conserve water consumption and minimize the size of pump required to provide pressurized fluid, valve 80 is controlled to provide pressurized fluid to only one set of nozzles during a predetermined time period. Valve 80 cycles to sequentially provide pressurized to each set of nozzles independently. Valve 80 may also be controlled to divert pumped fluid directly to a reservoir during the time when chamber 36 is in the open position. This allows the pump to be continuously run thereby avoiding start and stop pumping operational concerns, thus resulting in prolonged pump/motor life, Wash ring 71 also includes a guide bracket 84 and a hanger 86. Hanger 86 is free to slide axially relative to guide bracket 84 thereby translating halo 72 and nozzles 82 within chamber 36. An actuator 88 drivingly interconnects slide 38 and halo 72 to allow wash ring 71 to be translated back and forth across part 22 during the washing process.

Halo 72 and nozzles 82 may be driven back and forth a predetermined number of times or may be controlled to continue to wash part 22 until a predetermined parameter is met indicating that the part is clean. The predetermined parameter could be an indication by a visual inspection, a measurement of particulate count in the cleaning fluid or any other number of indicia. Once the washing cycle has been determined to be completed, chamber 36 is moved from a closed position to the open position by causing slide 38 to translate relative to table 40. At this time, part 22 may be transferred to drying station 26, if present.

Drying station 26 is constructed substantially similarly to washing station 24. Accordingly, similar components will be identified with like reference numerals including a "prime" designation. Preferably, operation of drying station 26 is coordinated with operation of washing station 24 such that chamber 36 and chamber 36' are substantially simultaneously located in their open and closed positions. When both chambers are in the open position, a part 22 is transferred from turntable 30 to part support structure 62 of washing station 24 while a recently washed part is transferred from part support structure 62 to part support structure 62' of drying station 26. One skilled in the art will appreciate that the adjacent positioning of washing station 24 and drying station 26 is merely exemplary and that washing station 24 may be utilized in the absence of a companion drying station 26 without departing from the scope of the present invention.

Figure 6:
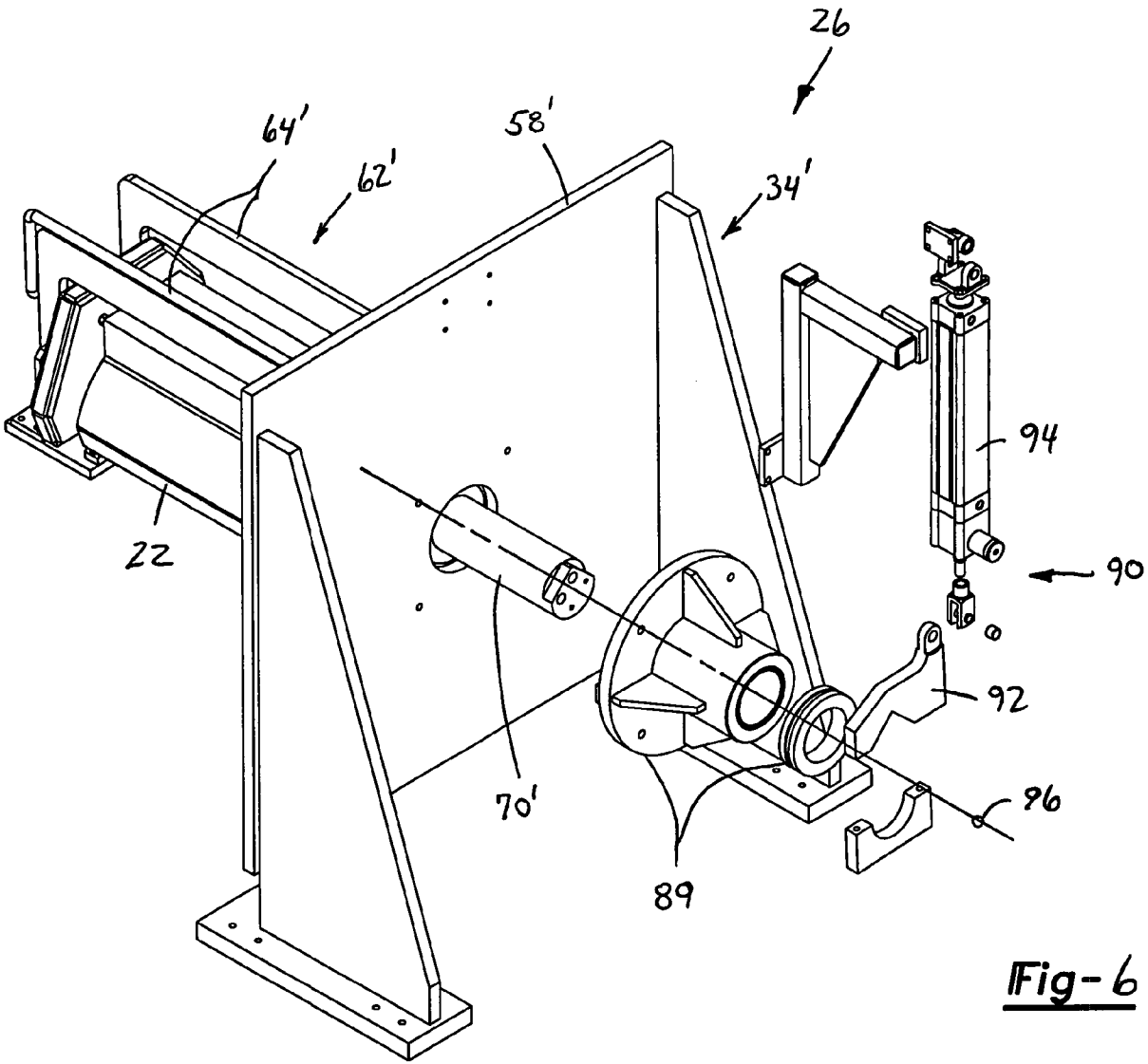
FIG. 6 is a partial exploded perspective view of a drying station of the industrial parts washer of the present invention.

During operation of drying station 26, chamber 36' is moved from the open to the closed position such that seal 56' engages mounting plate 58' of stand 34'. Compressed air or another drying agent is presented within enclosed volume 60' via nozzles 82'. Nozzles 82' may also be defined as air knives. Part support structure 62' is mounted to spindle 70' which is rotatably coupled to stand 34' by an end cap and bearing assembly 89. As shown in FIG. 6, an actuator mechanism 90 includes an arm 92 and a cylinder 94 coupled to spindle 70'. Actuator mechanism 90 functions to selectively rotate part support structure 62' and part 22 about a longitudinal axis 96.

In operation, halo 72' and air knives 82' are axially translated across part 22 while the part is located in a first orientation as shown in the Figures. Subsequently, actuator mechanism 90 causes part 22 to rotate 90 degrees to allow trapped debris and cleaning fluid to escape from internal passages of part 22. Pressurized air or dry air is again supplied to air knives 82' while actuator 88' translates halo 72' over the part.

Returning to FIG. 2, a pair of water return chutes 98 interconnect enclosed internal volume 60 and enclosed internal volume 60' to a settling tank 100. A conventional chip drag and chip waste mechanism 102 transports settled machining chips and debris from settling tank 100 to a dumpster 104. Cleaning fluid is pumped from settling tank 100 through filters 106 and re-circulated back to the supply for washing station 24. A method and apparatus for determining and maintaining the cleanliness of the fluid is described in U.S. patent application Ser. No. 10/342,977 which is hereby incorporated by reference. Parts washer 20 also includes an exhaust mist eliminator 108 which connects a vacuum source to chamber 36 and chamber 36'. Exhaust mist eliminators 108 and 108' substantially reduce the splatter of cleaning fluid during both washing and drying processes.

Furthermore, the foregoing discussion discloses and describes merely exemplary embodiments of the present invention. For example, the washing and drying stations of the present invention may be separated and used independently from one another. Additionally, any number of spray head configurations may be used in conjunction with a moveable housing without departing form the scope of the present invention. Additionally, one skilled in the art will readily recognize from such discussion, and from the accompanying drawings and claims, that various changes, modifications and variations may be made therein without department from the spirit and scope of the invention as defined in the following claims.

What is claimed is:

1. An industrial parts washer for cleaning a part, the industrial parts washer comprising:

a stand;

a frame coupled to said stand, said frame including a pair of inwardly extending portions adapted to support the part;

a chamber selectively moveable in a direction substantially parallel to the ground from a first position clear of the part to a second position engaging said stand, said stand and said chamber forming a sealed volume encapsulating the part and said chamber having a bottom extending beneath the part when said chamber is in said second position; and a nozzle coupled to a pressurized fluid supply, said nozzle being positioned within said chamber and moveable relative to the part.

2. The industrial parts washer of claim 1 further including a lift assembly operable to transfer the part from a first location to a location in contact with said frame.

3. The industrial parts washer of claim 1 wherein the inwardly extending portions are spaced apart from one another, a portion of said lift assembly being positionable between said inwardly extending portions.

4. The industrial parts washer of claim 1 wherein said chamber is translucent to allow viewing of the part from outside of the chamber when said chamber is in said second position.

5. The industrial parts washer of claim 1 further including a fluid circulating and filtration system operable to remove undesirable particles from said fluid after said fluid contacts the part and re-supply said nozzle with filtered cleaning fluid.

6. The industrial parts washer of claim 1 further including an exhaust system coupled to said chamber to remove cleaning fluid vapor from said sealed volume.

7. An industrial parts washer for cleaning a part, the industrial parts washer comprising:

a stand adapted to support the part;

a chamber selectively moveable in a direction substantially parallel to the ground from a first position clear of the part to a second position engaging said stand, said stand and said chamber forming a sealed volume encapsulating the part and said chamber having a bottom extending beneath the part when said chamber is in said second position;

a nozzle coupled to a pressurized fluid supply, said nozzle being positioned within said chamber and moveable relative to the part; and a slide supporting said chamber, said slide linearly moveable to selectively position said chamber in said first and second positions, said chamber including an aperture sized and positioned to receive the part during linear movement of said slide.

8. The industrial parts washer of claim 7 further including a moveable guide rod supporting said nozzle and an actuator drivingly interconnecting said guide rod and said slide, said guide rod extending through said slide such that a first portion of said guide rod is positioned within said chamber and another portion of said guide rod is positioned outside of said chamber.

9. The industrial parts washer of claim 8 wherein said actuator is positioned outside of said chamber.

10. The industrial parts washer of claim 7 wherein said chamber is cylindrically shaped.

11. The industrial parts washer of claim 7 further including a ring having a plurality of spaced apart nozzles mounted thereto, said ring adapted to substantially surrounding the part to provide a plurality of fluid paths directed toward the part.

12. An industrial parts washing station comprising:

a first part stand having a first frame adapted to support the part;

a second part stand having a second frame adapted to support the part;

a first chamber selectively moveable from a first position allowing access to said first frame to a second position to enclose said first frame;

a first nozzle moveably positioned within said first chamber, said first nozzle selectively operable to spray cleaning fluid within said first chamber;

a second chamber selectively moveable from a first position allowing access to said second frame to a second position enclosing said second frame;

a second nozzle moveably positioned within said second chamber, said second nozzle selectively operable to supply a drying agent within said second chamber; and a lift assembly operable to transfer the part from said first frame to said second frame when said first and second chambers are in the first position, wherein said first chamber is cantilever mounted on a slide moveable relative to said first part stand, said slide including a base portion positioned offset from and beneath said first chamber, a portion of said lift assembly being positioned between said base portion and said first chamber, said entire lift assembly being positioned outside of said first chamber when said first chamber is in said second position.

13. The industrial parts washing station of claim 12 further including a washing ring slidably positioned within said first chamber, said nozzle and a plurality of additional nozzles being mounted to said wash ring.

14. The industrial parts washing station of claim 12 wherein said first chamber is substantially identical to said second chamber.

15. The industrial parts washing station of claim 12 wherein said first chamber sealingly engages said first part stand when said first chamber is in said second position.

16. The industrial parts washing station of claim 12 wherein said drying agent is air.

* * * * *

UNITED STATES PATENT AND TRADEMARK OFFICE

CERTIFICATE OF CORRECTION

PATENT NO. : 7,353,832 B2
APPLICATION NO. : 10/646534
DATED : April 8, 2008
INVENTOR(S) : David L. Stockert, Timothy B. Evans and Robert J. Sobeck It is certified that error appears in the above-identified patent and that said Letters Patent is hereby corrected as shown below:

Column 3, line 48, after “pressurized”, insert --fluid--.

Column 3, line 54, “life,” should be --life--.

Column 4, line 64, “form” should be --from--.

Column 6, line 12, Claim 11, “surrounding” should be --surround--.

Signed and Sealed this

Twelfth Day of August, 2008

JON W. DUDAS
*Director of the United States Patent and Trademark Office*